US011878392B2

(12) United States Patent
Weickert

(10) Patent No.: US 11,878,392 B2
(45) Date of Patent: Jan. 23, 2024

(54) METHOD FOR THE HYDRO-EROSIVE GRINDING OF COMPONENTS

(71) Applicant: BASF SE, Ludwigshafen am Rhein (DE)

(72) Inventor: Mathias Weickert, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 636 days.

(21) Appl. No.: 15/734,222

(22) PCT Filed: May 21, 2019

(86) PCT No.: PCT/EP2019/063055
§ 371 (c)(1),
(2) Date: Dec. 1, 2020

(87) PCT Pub. No.: WO2019/228852
PCT Pub. Date: Dec. 5, 2019

(65) Prior Publication Data

US 2021/0205956 A1 Jul. 8, 2021

(30) Foreign Application Priority Data

Jun. 1, 2018 (EP) ..... 18175530

(51) Int. Cl.
*B24C 3/32* (2006.01)

(52) U.S. Cl.
CPC ..... *B24C 3/327* (2013.01)

(58) Field of Classification Search
CPC .. B24C 3/327; B24C 3/02; B24C 3/04; B24C 3/32; B24C 3/325; B24C 7/0023;
(Continued)

(56) References Cited

U.S. PATENT DOCUMENTS

2003/0134037 A1* 7/2003 Wang ..... B24C 3/327 134/22.12
2018/0207769 A1* 7/2018 Grau ..... B24C 7/0084
2019/0091826 A1* 3/2019 Adriany ..... B24C 7/0015

FOREIGN PATENT DOCUMENTS

EP 1787753 A1 5/2007
WO 2004/004973 A1 1/2004
WO 2014/000954 A1 1/2014

OTHER PUBLICATIONS

International Preliminary Report on Patentability received for PCT Patent Application No. PCT/EP2019/063055, dated Dec. 10, 2020, 12 pages (7 pages of English Translation and 5 pages of Original Document).

(Continued)

*Primary Examiner* — Joel D Crandall
*Assistant Examiner* — Michael A Gump
(74) *Attorney, Agent, or Firm* — Faegre Drinker Biddle & Reath LLP

(57) ABSTRACT

The invention relates to a method for the hydro-erosive processing of components, in which hydro-erosive grinding a liquid containing grinding particles flows over surfaces of the component (1), in a device having a channel (3), through which the liquid containing grinding particles flows under pressure and in which the component (1) to be ground is held and in which a valve (5) is positioned upstream of the component (1) in the flow direction, by means of which valve the flow of the liquid can be adjusted.

14 Claims, 1 Drawing Sheet

(58) Field of Classification Search
CPC ..... B24C 7/0007; B24C 7/0015; B24C 1/04; B24C 1/08; B24C 5/00; B24C 5/02; B24C 9/00; B24B 31/116
USPC ..... 451/36, 2, 3, 11, 38, 39, 40, 61, 76, 87, 451/89, 91, 101
See application file for complete search history.

(56) References Cited

OTHER PUBLICATIONS

International Search Report and Written Opinion received for PCT Patent Application No. PCT/EP2019/063055, dated Jul. 5, 2019, 17 pages (7 pages of English Translation and 10 pages of Original Document).
P. A. Rizkalla: "Development of a Hydroerosion Model using a Semi-Empirical Method Coupled with an Euler-Euler Approach", Jan. 1, 2011, pp. 1-277, XP055522729.

* cited by examiner

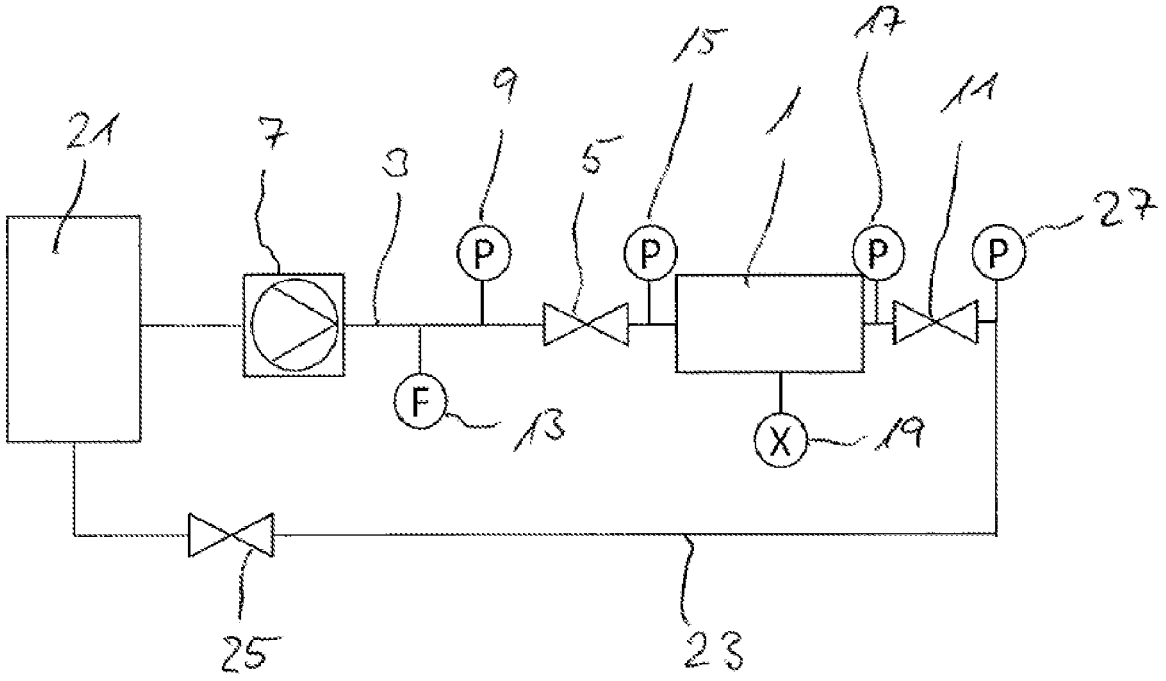
21
7
3
9
5
15
1
17
11
27
P
P
P
P
F
13
X
19
25
23

METHOD FOR THE HYDRO-EROSIVE GRINDING OF COMPONENTS

CORSS-REFERENCE TO RELATED APPLICATIONS

This application is a national stage application (under 35 U.S.C. § 371) of PCT/EP2019/063055, filed May 21, 2019, which claims benefit of European Application No. 18175530.7, filed Jun. 1, 2018, both of which are incorporated herein by reference in their entirety.

The invention relates to a method for the hydroerosive processing of components, in which a liquid comprising grinding particles flows over surfaces of the component.

Hydroerosive grinding methods are processing methods in which a liquid comprising grinding particles flows over a surface to be processed. The grinding particles contained in the liquid strike the surface of the component to be processed while the liquid is flowing over, so that the corresponding surface is erosively ground by the grinding particles eroding material of the component upon impact. Depending on the geometry, in particular the shape and the size distribution of the grinding particles, very fine processing of the surfaces, and in particular treatment of very fine structures, is in this case possible. Hydroerosive grinding methods may for example be used to treat the surfaces of 3D-printed components made of metal, ceramic and/or plastic which have a surface roughness of between 50 and 500 μm. These surface roughnesses lead to undesired effects during use of the corresponding components, for example fouling or increased pressure loss. In order to be able to comply with the exact geometry within the error tolerances after the grinding method, the geometry of the component may optionally need to be modified already during the production method, in particular during production by a 3D printing method, and it must be possible to adjust the grinding method precisely and in a controlled way.

From WO 2014/000954 A1, it is for example known to round bores on injection nozzles in injection valves for internal combustion engines by a hydroerosive method, so that sharp-edged transitions can in this way be ground on the very small bores through which the fuel is injected at high pressure into the internal combustion engine. For the method, a liquid comprising grinding particles flows through the injection nozzle. For uniform flow through the bore of the injection nozzle, and therefore uniform rounding of the edges, a hollow body is introduced into the injection valve and the liquid comprising grinding particles is guided through the inner flow channel formed in the hollow body and an outer flow channel formed between the hollow body and the inner wall of the injection valve. In this case, for a uniform result, it is possible to use liquids comprising different grinding particles, which flow through the inner and outer flow channels, and/or to deliver the liquid comprising grinding particles through the inner and outer flow channels with different flow rates or pressures.

A mathematical simulation of the hydroerosive grinding method is described, for example, in P. A. Rizkalla, Development of a Hydroerosion Model using a Semi-Empirical Method Coupled with an Euler-Euler Approach, Dissertation, Royal Melbourne Institute of Technology, University of Melbourne, November 2007, pages 36 to 44.

A disadvantage with the method known from the prior art is that, in particular for surfaces to be ground on which there are flow obstacles, for example in the form of an element fitted on the surface, or for components in which the liquid comprising grinding particles needs to be deviated, for example when the surface to be ground is a bore which opens into a channel, as is also the case for the injection nozzles described in WO 2014/000954 A1, vortices and reverse flows may occur, because of which nonuniform grinding takes place or many positions remain unprocessed.

The object of the present invention is therefore to provide a method for the hydroerosive processing of surfaces, in which controlled processing of the surface is ensured.

This object is achieved by a method for the hydroerosive processing of components, in which a liquid comprising grinding particles flows over surfaces of the component, in a device having a channel through which the liquid comprising grinding particles flows under pressure and in which the component to be processed is received, and in which a valve, with which the flow of the liquid can be adjusted, is positioned in front of the component in the flow direction, comprising the following steps:

(a) closing the valve in front of the component and generating a predetermined pressure in the liquid comprising the grinding particles;

(b) opening the valve in front of the component and setting up a first volumetric flow of the liquid comprising the grinding particles, which is from 5 to 80% less than the product of the minimum setpoint cross-sectional area flowed through and the maximum permissible speed at this position, without the predetermined pressure generated in step (a) being changed;

(c) measuring the pressure difference which is set up between a position in front of the component to be processed and a position behind the component to be processed in the liquid comprising the grinding particles;

(d) increasing the volumetric flow of the liquid comprising the grinding particles until the volumetric flow corresponds to the product of the minimum setpoint cross-sectional area flowed through and the maximum permissible speed at this position, as soon as the pressure difference measured in step (c) has decreased by from 5 to 80%;

(e) closing the valve in front of the component and terminating the flow, as soon as the volumetric flow in step (d) corresponds to the product of the minimum setpoint cross-sectional area flowed through and the maximum permissible speed at this position.

As a result of adjusting the volumetric flow to from 5 to 80% less than the product of the minimum setpoint cross-sectional area flowed through and the maximum permissible speed at this position, without the predetermined pressure generated in step (a) being changed in step (b), uniform flow over the surface to be processed is achieved, and possible reverse flows, in which excessively strong erosion of the surface takes place, are reduced. Complete avoidance of reverse flows is not possible, since this would require such a low flow rate that either no material is ground off or the grinding process is slowed so much that economical operation of the grinding process is no longer possible. By the grinding, sharp-edged transitions are rounded so that because of the processing, the perturbation causing the reverse flow and vortices is reduced, which allows an increase in the volumetric flow and the flow rate. A further increase in the volumetric flow results from the increase, due to the grinding process in which material is eroded, in the cross section flowed through, so that even the increased cross section requires an increase in the volumetric flow in order to keep the flow rate constant.

For the hydroerosive processing, first the component is introduced into a channel through which the liquid comprising grinding particles flows. If outer surfaces of the component are intended to be processed, the component is introduced into the channel in such a way that the liquid comprising grinding particles can flow over the surfaces. In the case of processing inner surfaces, for example bores, the component is connected to the channel in such a way that the liquid comprising grinding particles flows through the openings to be processed, for example bores, but does not come in contact with surfaces which are not intended to be processed. For the grinding of bores, for example, suitable connections may be provided on the component, through which the liquid comprising grinding particles is supplied and flows out of the component.

In order to avoid cavitation, which may lead to uncontrolled material erosion and therefore destruction of the component, at the start the pressure of the liquid comprising grinding particles is increased without the liquid flowing over the surfaces to be processed. To this end, a valve in front of the component to be processed in the flow direction is initially closed. By closure of the valve and the pressure increase before the start of the flow over or through the liquid comprising grinding particles, by reopening the valve it is possible to deliberately control the flow of the liquid comprising grinding particles. Cavitation can be prevented by the increased pressure, since the static pressure in the liquid, which decreases because of the high speed, can be kept above the vapor pressure of the liquid because of the high pressure, so that no vapor bubbles are formed which are entrained with the flow and, when reaching regions with a higher pressure, suddenly collapse so that a local reduced pressure is created, which may cause damage to the surfaces.

In order to increase the pressure of the liquid comprising grinding particles when the valve is closed in step (a), for example, it is possible to use a pump which is located in front of the valve in the flow direction. The pressure which is generated in the liquid comprising grinding particles preferably lies in the range of from 1.1 to 500 bar(abs), the pressure being dependent on the material of the component to be processed. If a surface made of metal or ceramic is intended to be processed by the hydroerosive grinding method, a pressure is preferably set up which is in the range of from 10 to 500 bar(abs), more preferably from 10 to 200 bar(abs) and in particular from 50 to 150 bar(abs), for example 100 bar(abs). In the case of a surface made of plastic, a pressure in the range of from 1.1 to 100 bar(abs), more preferably in the range of from 1.5 to 10 bar(abs), and particularly in the range of from 1.5 to 3 bar(abs), is preferably set up. In order to measure the pressure of the liquid comprising the grinding particles in step (a), it is preferable to use a first pressure sensor which is positioned between the valve in front of the component and the pump with which the pressure and the flow of the liquid comprising grinding particles is generated.

Any pump with which the pressure in the liquid comprising grinding particles can be increased, without the pump being damaged by the grinding particles comprised in the liquid, is suitable as a pump for increasing the pressure and generating the flow, as soon as the valve in front of the component is opened. Such damage to the pump may, for example, result from the grinding effect of the particles, particularly in regions with flow deviation. Diaphragm pumps are therefore particularly preferred as a pump for increasing the pressure of the liquid comprising grinding particles.

After the increase in the pressure of the liquid comprising grinding particles, the valve in front of the component is opened and a first volumetric flow of the liquid comprising the grinding particles is set up, which is from 5 to 80% less than the product of the minimum setpoint cross-sectional area flowed through and the maximum permissible speed at this position, without the predetermined pressure generated in step (a) being changed. Preferably, the volumetric flow is from 10 to 40%, and in particular from 15 to 25%, less than the product of the minimum setpoint cross-sectional area flowed through and the maximum permissible speed at this position. A setpoint cross-sectional area refers to the cross-sectional area which is generated by the hydroerosive grinding method and which the fully processed component has, the cross-sectional area being oriented perpendicularly to the principal flow direction of the liquid comprising the grinding particles.

The maximum flow rate of the liquid comprising the grinding particles is preferably from 1 m/s to 99% of the speed of sound of the liquid, preferably from 10 to 200 m/s and in particular from 50 to 150 m/s, for example 100 m/s. Since, with constant volumetric flow, the speed of the liquid increases with a decreasing cross-sectional area flowed through, and correspondingly decreases with increasing cross-sectional area flowed through, the maximum speed of the liquid comprising the grinding particles occurs at the position where the minimum cross-sectional area is flowed through. The speed in this case refers to the average speed of the liquid over a cross-sectional area, which may for example be determined by measuring the volumetric flow and dividing by the cross-sectional area.

If, with the adjusted speed of the liquid comprising the grinding particles, it is found that cavitation occurs, the volumetric flow is reduced until cavitation is no longer detected. In order to detect cavitation, for example, a sound sensor is positioned in the channel behind the component. Since sound waves are generated by the vapor bubbles imploding during cavitation, and the reduced pressure resulting therefrom, which generate a noise, the cavitation can straightforwardly be detected by the sound sensor. If a large number of bubbles are formed, and correspondingly strong cavitation therefore occurs, the noises of the individual bubbles combine to form rattling.

Because of the hydroerosive grinding process, in which material is eroded by the grinding particles comprised in the liquid from the surface of the component to be processed, the shape of the component changes and the cross-sectional area flowed through increases. This leads to a reduction of the pressure loss in the liquid comprising the grinding particles. This reduction of the pressure loss is detected in step (c). In order to detect the pressure loss, the pressure difference between the pressure in front of the component in the flow direction of the liquid and the pressure behind the component in the flow direction is preferably determined. To this end, the pressure may be measured by a second pressure sensor, which is positioned between the valve in front of the component and the component, and a third pressure sensor which is positioned behind the component. The pressure measured behind the component is then subtracted from the pressure measured in front of the component in order to form the pressure difference.

In the scope of the present invention, the position indications "in front of" and "behind" always refer to the flow direction of the liquid comprising the grinding particles during the grinding process. "In front of . . . " therefore always means "in front of . . . in the flow direction of the liquid" and "behind . . . " correspondingly always means "behind . . . in the flow direction of the liquid"

Since, with an increasing duration of the hydroerosive grinding, sharp-edged obstacles flowed around are ground and the risk of vortices forming with reverse flow regions is therefore reduced, the volumetric flow of the liquid may be increased in the course of the grinding method. Furthermore, the grinding of sharp edges and the increase in the cross-sectional area flowed through, because of the material eroded by the grinding, leads to a change in the flow conditions in the liquid comprising the grinding particles, as a result of which the grinding effect is reduced. For this reason, according to the invention, in step (d) the volumetric flow of the liquid comprising the grinding particles is increased until the volumetric flow corresponds to the product of the minimum setpoint cross-sectional area flowed through and the maximum permissible speed at this position, as soon as the pressure difference measured in step (c) has decreased by from 5 to 80%. Preferably, in step (d), the volumetric flow of the liquid comprising the grinding particles is increased as soon as the pressure difference measured in step (c) has decreased by from 10 to 30%, and in particular by from 15 to 25%, for example 20%.

The increase in the volumetric flow may then be carried out in individual steps, the volumetric flow being increased at each reduction of the pressure loss, or the volumetric flow being increased continuously, constantly and monotonically increasingly in step (d). Such a continuous, constant and monotonically increasing increase of the pressure loss is in this case preferred, since reverse flow regions and therefore cavitation may occur when the volumetric flow is increased in individual steps.

The maximum permissible speed of the flow comprising the grinding particles is the speed at which the surface is ground in the desired way and undesired material erosion, for example due to reverse flows or due to cavitation, does not yet occur. The maximum permissible speed may in this case, for example, be determined by preliminary tests. It is, however, an alternative and preferred to determine the maximum permissible speed by a simulation calculation.

The increase in the volumetric flow is preferably carried out so rapidly that the provided process time for processing the component until reaching the maximum volumetric flow is not exceeded. The process time is in this case likewise determined by the preliminary tests or by the simulation calculation. In addition, a characteristic curve between the pressure loss and the volumetric flow, which indicates the erosion, may also be compiled by the preliminary tests or the simulation calculation. With the aid of the characteristic curve, the erosion can be read as a function of the pressure loss and the volumetric flow, and the conditions required for the desired erosion can be determined from the characteristic curve.

For determining the maximum speed, the mathematical simulation described below for step (ii) is likewise suitable, if the maximum speed is intended to be determined by a simulation and not by preliminary tests.

In order to obtain a finished part with desired dimensions, it is furthermore advantageous for the geometry of the component likewise to be modeled in a simulation calculation before the grinding process. In this way, it is possible to produce a raw part of the component which has a geometry such that the component has the desired geometry within predetermined tolerances after the erosion of material by the hydroerosive grinding. Such a simulation method suitable for determining the geometry of the raw part of the component, which is shaped to form the finished part in a hydroerosive grinding method, has for example the following steps:

(i) creation of a structural model of the finished part to be produced, the structural model of the finished part to be produced being used as an initial model for the first part execution of the next step (ii);

(ii) mathematical simulation of the hydroerosive grinding method, with which an intermediate model with a modified geometry is produced starting from an initial model;

(iii) comparison of the intermediate model produced in step (ii) with the structural model of the finished part and determination of the distance, orthogonal to the surface of the structural model of the finished part, between the structural model of the finished part to be produced and the intermediate model at each node of the structural model, and comparison of the orthogonal distance with a predetermined limit value;

(iv) creation of a modified model of the component by adding from 5 to 99% of the distance determined in step (iii) with the opposite sign at each node on the surface of the model which is used as an initial model in step (ii), orthogonally to the surface, and repetition of steps (ii) to (iv), the modified model created in step (iv) being used as a new initial model in step (ii) if the orthogonal distance determined in step (iii) at at least one node is greater than the predetermined limit value;

(v) termination of the simulation when the orthogonal distance, determined in step (iii), between the structural model of the finished part and the intermediate model at each node falls below a predetermined limit value, the initial model of the step (b) carried out last corresponding to the raw part geometry to be determined.

By this method, it is possible to determine, within a predetermined tolerance for the finished part, the geometry which a raw part must have so that the desired shaped part is formed during the hydroerosive grinding method carried out.

In order to generate the structural model of the finished part to be produced, a three-dimensional image of the desired finished part is preferably initially generated with any desired computer-aided design program (CAD program). During the creation of the three-dimensional image of the desired finished part, it is necessary to take care that it reflects the desired finished part exactly true to scale. The image created in this way is subsequently transferred into the structural model. For the structural model, a grid is placed over the image of the finished part. In this case, it is necessary to take care that the individual nodes of the grid, i.e. the points at which at least two grid lines touch at an angle not equal to 180°, are selected in such a way that the structural model still reflects the desired finished part with sufficient precision. Particularly on small structures, for example small radii or curvatures, the distance between two nodes must be small enough to still describe the geometry accurately. Since, at positions of the component at which the flow of the liquid comprising the grinding particles is perturbed, for example at elevations or depressions on the surface, the flow modified in this way leads to a modified effect of the grinding particles on the surface, the distance between the individual nodes should also be selected to be sufficiently small at such positions. The distance to be selected between the nodes is in this case dependent on the size of the component to be processed and the required dimensional tolerances of the finished part. The greater the dimensional tolerances are, the greater the distance between two nodes can be selected to be. With an increasing distance from the surface to be processed, the distance between two nodes may likewise be increased. If a simulation program which also makes it possible to generate an image of the finished part is used for the calculation in step (ii), the same program may of course be used for creating the image and for generating the structural model from the image.

The way in which a suitable structural model is constructed is known to the person skilled in the art, and conventional simulation programs, which in general also comprise modules for generating the structural model, may be used for creating the structural model. Depending on the desired calculation method in step (ii), it is possible to use simulation programs which operate with finite differences, finite elements or finite volumes. Conventional and preferred is the use of simulation programs based on finite elements, as are available for example from ANSYS®.

In step (ii), starting from an initial model, the hydroerosive grinding method is mathematically simulated, an intermediate model being generated by the mathematical simulation. For the mathematical simulation of the hydroerosive grinding method, on the one hand the flow of the liquid comprising the grinding particles, and on the other hand the transport of the grinding particles in the liquid, and in connection with this the impact of the grinding particles on the component to be processed and the material erosion resulting therefrom are mathematically simulated. For the calculation, commercially available simulation programs may be used. One possible model for the hydroerosive grinding method is described, for example, in P. A. Rizkalla, Development of a Hydroerosion Model using a Semi-Empirical Method Coupled with an Euler-Euler Approach, Dissertation, Royal Melbourne Institute of Technology, University of Melbourne, November 2007, pages 36 to 44. Besides the mathematical simulation described here, however, it is possible to use any other mathematical simulation, known to the person skilled in the art, of the grinding method, with which the erosion and form of the erosion of material from a surface by the grinding particles contained in the liquid is described.

As already described above, the mathematical simulation may be carried out with a finite difference method, a finite element method or a finite volume method, commercial simulation programs generally using finite element methods.

Process data which correspond to the intended subsequent production process are preferably used as boundary conditions and substance data for the mathematical simulation. The substance data which are used for the mathematical simulation should also correspond to those of the intended subsequent production method. For example, pressure, temperature and volumetric flow of the liquid comprising the grinding particles which is used are used as boundary conditions for the mathematical simulation of the hydroerosive grinding method. Substance data, which are used for the mathematical simulation, of the liquid comprising the grinding particles, are for example the viscosity of the liquid and the density of the liquid, and further substance data are the size, shape and material of the grinding particles as well as the amount of grinding particles in the liquid. Further process data are the geometrical shape of the component, which shape is used as a structural model, as well as the geometrical shape of channels through which the liquid comprising the grinding particles is transported. A further process quantity which may be used for the mathematical simulation is the duration of the grinding method.

Changes in the process conditions while the hydroerosive grinding method is being carried out, for example pressure or temperature of the liquid comprising the grinding particles, and in particular volumetric flow of the liquid comprising the grinding particles, these changes in the process conditions are correspondingly also taken into account in the mathematical simulation of the grinding method. Besides the changes in the volumetric flow and the pressure, the changes in the process conditions also relate to changes in the geometry during the grinding method.

As a result of the mathematical simulation of the hydroerosive grinding method in step (ii), the intermediate model has a geometry that corresponds to the geometry which is formed when the initial model is subjected to the hydroerosive grinding method. Since the structural model of the finished part is used as an initial model when carrying out step (ii) for the first time, the intermediate model determined when carrying out step (ii) for the first time has a shape in which the processed surface has been modified in such a way that the intermediate model generated reflects a component of which the surfaces have been ground starting from the finished part. The intermediate model thus has a geometry which differs from the desired geometry of the finished part essentially exactly in the opposite way to the shape which is required as an initial model, in order to obtain the desired finished part at the end of the grinding process.

In order to approximate the shape of the raw part which is required in order to obtain the desired finished part within the required tolerances, in step (iii) the intermediate model generated in step (ii) is compared with the structural model of the finished part, and the distance, orthogonal to the surface of the structural model of the finished part, between the structural model of the finished part to be produced and the intermediate model is determined at each node of the structural model. This orthogonal distance determined at each node is compared with a predetermined limit value. The predetermined limit value is in this case preferably the dimensional tolerance of the finished part.

If the orthogonal distance between the structural model of the finished part and the intermediate model determined in step (ii) is greater than the predetermined limit value at least one node, step (iv) is carried out, and if the orthogonal distance between the structural model of the finished part and the intermediate model determined in step (ii) is less than the predetermined limit value at all the nodes, step (v) is carried out and the method is ended.

In step (iv), a modified model of the component is created by adding from 5 to 99% of the distance determined in step (iii), preferably from 30 to 70% of the orthogonal distance determined in step (iii), and in particular from 40 to 60%, for example 50%, of the distance determined in step (iii) with the opposite sign at each node on the surface of the model which is used as an initial model in step (ii), orthogonally to the surface of the initial model. Subsequently, steps (ii) to (iv) are repeated, the modified model created in step (iv) being used as a new initial model in step (ii). The fact that from 5 to 99%, preferably from 30 to 70%, in particular from 40 to 60%, for example 50%, of the orthogonal distance determined in step (iii), rather than the entire orthogonal distance determined in step (iii) is added to the initial model used in step (ii) ensures that the method converges and in all cases a geometry is found for the raw part from which the finished part is produced in the hydroerosive grinding method.

As a result of the comparison of the intermediate model generated in step (ii) with the structural model of the finished part in step (iii), in each execution the orthogonal distance which still leads to a deviation of the initial model from the finished part is registered. By adding a part of this orthogonal distance to the initial model in step (ii) in order to create a new initial model for the subsequent execution of steps (ii) to (iv), in each execution the shape of the required raw part is approximated more closely. This iterative method leads to the required shape of the raw part in order to produce the finished part by a hydroerosive grinding method, as soon as the intermediate model generated in step (ii) has at each node an orthogonal distance from the structural model of the finished part which is less than the predetermined limit value. The shape of the raw part is in this case reflected by the initial model in step (ii), in which the model whose surface corresponds to the finished part within the predetermined tolerances, i.e. within the predetermined limit values, is generated as an intermediate model.

Depending on the finished part to be created, the required tolerances, and therefore the predetermined limit values, may be equal over the entire surface to be processed of the finished part to be produced. It is, however, also possible to specify different tolerances for different surfaces or different regions of the surface of the finished part, so that different limit values for the orthogonal distance between the intermediate model from step (ii) and the structural model of the finished part are then also obtained.

With the hydroerosive grinding method, both surfaces on the outside of the component and surfaces inside the component can be processed. Usual surfaces inside a component are for example bores or channels, which are routed through the component. The hydroerosive grinding method is used, in particular, when the surfaces to be processed cannot be reached with conventional tools, for example when an opening from a channel or a bore in a component branches and the entry edges into the opening are intended to be rounded, or when there is a flow obstacle on the inside, for example in the form of a cross-sectional constriction, or a channel is routed around one or more corners.

When outer surfaces of the component are intended to be processed with the hydroerosive grinding method, the component is preferably positioned inside the channel so that the liquid comprising grinding particles can flow over the outer surfaces. To this end, the component is preferably held in the channel with suitable holding elements, for example rods. As an alternative, it is also possible to introduce the component into a suitable mount, through which the liquid can flow and onto which the channel is fitted on both sides of the component by a suitable coupling, for example a flange. Such positioning of the component in the channel is also possible when inner and outer surfaces of the component are intended to be hydroerosively processed. In this case, in particular, care should be taken that the openings for the liquid comprising grinding particles to flow into the component are oriented in such a way that the liquid flows through the component with a sufficiently high speed and the inner surfaces are thus processed.

As an alternative, it is also possible first to close all openings on the component and only to process the outer surfaces, and subsequently to connect the component to a channel so that only the inner surfaces are flowed over. Correspondingly, the component is also then connected to a channel so that only the inner surfaces are flowed over, when no outer surfaces are intended to be processed.

In the event that both the inner and outer surfaces are intended to be processed, it is of course also possible to process first the inner surfaces and then, after closing the openings in the component, the outer surfaces.

The connection of the component for processing inner surfaces may, for example, be carried out as described in WO 2014/000954 A1. As an alternative, the channel through which the liquid comprising grinding particles flows may also be connected to an inlet opening of the component and an outlet opening of the component, so that the liquid comprising grinding particles flows out of the channel through the inlet opening into the opening to be processed of the component, flows over the surfaces to be processed in the component, and then back into the channel through the outlet opening.

In order to be able to adjust the flow of the liquid comprising the grinding particles precisely, in particular the volumetric flow and the desired pressure drop across the component, it is particularly preferred for a second valve to be positioned behind the component, in addition to the valve in front of the component. The volumetric flow and the pressure in the liquid comprising the grinding particles are then adjusted by means of the first and second valves. The valve behind the component makes it possible, in particular, to keep the pressure in the liquid in the component so high that no cavitation occurs. To this end, the valve behind the component is opened only wide enough that the desired pressure can be maintained with the pump. This pressure is measured with the third pressure sensor, which is located behind the component. To this end, the third pressure sensor is located between the component and the valve behind the component.

As soon as the volumetric flow in step (d) corresponds to the product of the minimum setpoint cross-sectional area flowed through and the maximum permissible speed at this position the processing of the component is terminated and the flow of the liquid comprising the grinding particles is ended. If a valve is only provided in front of the component, this valve is closed for this purpose. If one valve is in front of the component and a second valve is behind the component, the second valve behind the component is closed before closing the valve in front of the component in step (e).

If it is not possible to reach all positions to be processed of the surfaces by the above-described processing of the component, it is possible either to reposition the component in the channel so that the liquid comprising the grinding particles flows over the surfaces to be processed in a direction different to the first direction, for example in the opposite direction. As an alternative, it is also possible to keep the component in the original position in the channel and to reverse the flow direction of the liquid comprising the grinding particles, so that it flows over the surfaces to be processed in the opposite direction. To this end, either a second pump is used on the other side of the component, the pump which is not required preferably in each case being circumvented by means of a bypass, or alternatively one pump which can reverse the delivery direction is used. It is, however, preferred to use two pumps.

The liquid comprising the grinding particles is preferably provided in a storage container and flows back into the storage container after flowing over the surfaces to be processed of the component. In this way, continuous hydroerosive grinding is possible, without fresh liquid comprising grinding particles constantly having to be provided. In order to remove material eroded from the component from the liquid comprising the grinding particles, it is advantageous for the grinding particles to have different physical properties than the material of the component. In the case of a nonmagnetizable material of the component, for example, magnetizable grinding particles may be used so that the grinding particles can be separated with the aid of a magnet from the material separated from the component. Correspondingly, in the case of a magnetizable material, the material separated from the component may be straightforwardly removed from the liquid with a magnet if the grinding particles are nonmagnetizable. As an alternative, separation as a result of the force of gravity is also possible in the case of a different density, or separation with the aid of filters if the particles of material separated from the component have a different size to the grinding particles.

As an alternative, it is also possible to return only a part of the liquid comprising the grinding particles back into the storage container, and to remove a part from the method, so as also to remove a part of the separated material with this removed part. The removed part is then replaced with fresh liquid comprising grinding particles.

Because of the high outlay of separating material separated as very small particles from the component and the likewise very small grinding particles, it is particularly preferred to fully replace the liquid comprising the grinding particles at predetermined intervals. The predetermined intervals may in this case depend on the one hand on the number of components processed, or on the other hand on the time of use of the liquid comprising the grinding particles.

In order to prevent sudden relaxation of the liquid in the storage container, which may possibly lead to evaporation, it is preferred for the liquid comprising grinding particles which is fed back into the storage container to be relaxed before flowing into the storage container. In order to relax the liquid, for example, a throttle or a valve may be used.

In order to reduce the speed of the grinding particles when entering the storage container, it is furthermore advantageous to increase the cross-sectional area of the channel. In this case, it is preferred for the cross-sectional area not to be widened too suddenly, in order to prevent strong vortices being formed in the liquid, which may lead to damage to the wall of the channel by grinding with the particles contained in the liquid. If a throttle or a valve is used in order to relax the liquid, it is furthermore preferred for a fourth pressure sensor to be provided behind the relaxation member, with which the pressure of the liquid is measured before flowing into the storage container. Preferably, this pressure is used in order to regulate the relaxation member, so that the liquid always flows back into the storage container in a predetermined pressure range.

In order to keep the grinding particles distributed uniformly in the liquid, it is advantageous for the storage container to have a stirrer with which the liquid comprising grinding particles can be stirred.

As a liquid for the liquid comprising grinding particles, natural or synthetic oils are suitable in particular, in particular hydraulic oils, or water. Suitable hydraulic oils are commercially available, for example as Shell Morlina® 10-60 or Shell Clavus® 32.

The material used for the grinding particles is dependent on the material of the component to be processed. If the component is made of a metal or a ceramic, grinding particles made of boron carbide or diamond are preferably used. In the case of a component made of a plastic, grinding particles made of boron carbide, diamond, sand or silicon are suitable in particular. The shape and the size of the grinding particles is also dependent on the material to be processed of the component, and on the desired surface condition, in particular the desired surface roughness, and the size of the structure to be processed. Suitable particle shapes for the grinding particles are in particular sharp-edged particles, for example fractured particles. Suitable grinding particles preferably have a size distribution of from 1 to 100 μm, and in particular a size distribution of from 1 to 10 μm.

In order to clean the component to be processed of residues of grinding particles or eroded material, the component is generally washed after the processing with the liquid comprising the grinding particles. To this end, either water or oils, for example synthetic or natural oils, may be used. It is particularly preferred to use the same liquid for the washing as was used previously for processing the component, the liquid for the washing comprising no grinding particles.

An exemplary embodiment of the invention is represented in the FIGURE and will be explained in more detail in the following description.

The single FIGURE shows a method flow diagram of the method according to the invention.

For the processing by a hydroerosive grinding method, a component 1 is introduced into a channel 3 through which a liquid comprising grinding particles flows. The positioning of the component 1 is in this case dependent on the surface to be processed. If outer surfaces on the component are intended to be processed, the component 1 is introduced into the channel 3 so that the liquid comprising grinding particles can flow over the outer surfaces to be processed. To this end, the channel 3 is enclosed by a wall on all sides and the component 1 is located inside the channel. The component 1 is then fixed in the channel 3 with suitable fastening means, for example rods. If inner surfaces, for example of bores or channels in the component 1, are intended to be processed, the channel 3 is connected to the component so that the liquid comprising the grinding particles can flow over the inner surfaces of the component 1. To this end, for example, the channel 3 may be connected with a suitable coupling directly to the opening, for example the bore or the channel in the component 1.

In order to be able to adjust the flow of the liquid comprising the grinding particles, there is a first valve 5 in the flow direction of the liquid comprising the grinding particles. Initially, the first valve 5 is closed. Then, with a pump 7, preferably a diaphragm pump, the pressure is increased in the liquid comprising the grinding particles in the channel 3 between the pump 7 and the first valve 5. The pressure, which is adjusted using the pump 7 with the first valve 5 closed, is dependent on the material of the component to be processed. If the surface to be processed of the component 1 is made of a metal or a ceramic, a pressure in the range of from 10 to 500 bar(abs), more preferably from 10 to 200 bar(abs), and in particular from 50 to 150 bar(abs) is preferably built up, and in the case of a surface to be processed of the component 1 made of a plastic, a pressure in the range of from 1.1 to 100 bar(abs), more preferably in the range of from 1.5 to 10 bar(abs), and particularly in the range of from 1.5 to 3 bar(abs). The pressure which is built up using the pump 7 with the first valve 5 closed is in this case measured with a first pressure sensor 9.

After the pressure buildup, the first valve 5 is initially opened partially. Preferably, the first valve 5 is opened to from 5 to 80%, more preferably from 10 to 40%, in particular from 15 to 25%, for example 20%, of the maximum cross-sectional area flowed through in the valve. Subsequently, a second valve 11, which is arranged behind the component 1 to be processed in the flow direction of the liquid comprising the grinding particles, is opened, the second valve 11 being opened only wide enough for the pressure generated by the pump 7 and measured at the first pressure sensor 9 to be maintained, and for a desired volumetric flow of the liquid comprising the grinding particles to be set up. The volumetric flow is in this case measured with a suitable sensor 13, for example a through-flow sensor. The volumetric flow, which is set up with the first valve 5 and the second valve 11, is in this case preferably from 5 to 80%, more preferably from 10 to 40%, and in particular from 15 to 15%, for example 20%, of the product of the minimum setpoint cross-sectional area flowed through and the maximum permissible speed at this position.

While the liquid comprising the grinding particles is flowing over the surface to be processed, the pressure difference in the liquid comprising the grinding particles is detected. To this end, in the embodiment shown here, a second pressure sensor 15 is arranged in front of the component and a third pressure sensor 17 is arranged behind the component. The second pressure sensor 15 is in this case preferably located, as represented here, between the first valve 5 and the component 1 and the third pressure sensor 17 between the component 1 and the second valve 11. In order to determine the pressure difference, the pressure measured at the third pressure sensor 17 is subtracted from the pressure measured at the second pressure sensor 15.

Edges and corners in the component are rounded by the hydroerosive grinding. Furthermore, the cross-sectional area flowed through is increased. These modifications on the component lead to a reduction in the pressure difference for a constant volumetric flow.

As soon as the pressure difference detected between the second pressure sensor 15 and the third pressure sensor 17 is decreased by from 5 to 80%, preferably from 10 to 30%, in particular from 15 to 25%, for example 20%, the volumetric flow of the liquid comprising the grinding particles is increased. The increase in the volumetric flow is in this case preferably carried out continuously, constantly and monotonically increasingly until the volumetric flow corresponds to the product of the minimum setpoint cross-sectional area flowed through in the component and the maximum permissible speed. As soon as this value is reached, the flow of the liquid comprising the grinding particles is terminated, the pump is turned off, and first the second valve 11 and then the first valve 5 are closed.

In order to prevent cavitation during the grinding process, which may lead to undesired material erosion and therefore damage to the component, a sound sensor 19 is preferably provided. With the sound sensor, undesired sounds in the flowing liquid comprising the grinding particles, in particular noise or rattling produced as a result of implosion of the vapor bubbles formed by cavitation may be detected. As soon as sounds detected with the sound sensor indicate cavitation setting in, the volumetric flow is reduced so that the susceptibility to cavitation is also reduced. In this way, the hydroerosive grinding method can be operated in such a way that no cavitation, and therefore no undesired material erosion, occurs.

The liquid comprising the grinding particles is preferably taken from a storage container 21 during the hydroerosive grinding process. The storage container 21 may in this case be equipped with a stirrer in order to prevent agglomeration and sedimentation of the grinding particles.

After flowing through the component, the liquid comprising the grinding particles is preferably fed back through a return line 23 into the storage container 21. Before entering the storage container, the liquid comprising the grinding particles is relaxed in a relaxation member 25. For example, a throttle or a valve is suitable as the relaxation member 25. As an alternative, in order to relax the liquid comprising the grinding particles and reduce the speed, it is possible to increase the flow cross section of the return line 23. If a controllable or regulatable relaxation member 25 is used, it is advantageous to measure the pressure in the liquid comprising the grinding particles with a fourth pressure sensor 27, and to control and/or regulate the relaxation member 25 with the at the fourth pressure sensor 27, so as to introduce the liquid comprising grinding particles with a flow rate and/or with a pressure which varies within the limits specified for the control and/or regulation into the storage container 21.

Since the liquid comprising the grinding particles flushes and entrains the material, eroded during the hydroerosive processing, of the component 1, the liquid comprising the grinding particles is contaminated by the eroded material. In order to be able to use the liquid comprising the grinding particles over a longer period of time, it is then possible to remove the eroded material by a suitable separating method from the liquid comprising the grinding particles. To this end, either a suitable separating device may be provided in the return line 23, or a part of the liquid comprising the grinding particles is removed either from the storage container 21 or from the return line 23 and sent to treatment in which the eroded material is removed from the liquid comprising the grinding particles. The liquid comprising the grinding particles which has been treated in this way can then be returned to the storage container.

As an alternative, continuously or at regular intervals which are either dependent on the proportion of the eroded material in the liquid comprising the grinding particles or selected to be constant, it is also possible to remove a part of the liquid from the method and replace it with fresh liquid comprising grinding particles. Furthermore, it is also possible to determine the proportion of the eroded material by continuous tests or tests at regular predetermined intervals, and when reaching a predetermined maximum proportion of eroded material, to replace all of the liquid comprising grinding particles with fresh liquid comprising grinding particles.

Besides the embodiment presented here, with recycled liquid comprising grinding particles, it is as an alternative of course also possible always to carry out the hydroerosive grinding with fresh liquid comprising grinding particles, and to remove from the process, dispose of or treat, the liquid comprising grinding particles after flowing over the surfaces to be processed.

LIST OF REFERENCES

1 component
3 channel
5 first valve
7 pump
9 first pressure sensor
11 second valve
13 sensor for measuring the volumetric flow
15 second pressure sensor
17 third pressure sensor
19 sound sensor
21 storage container
23 return line
25 relaxation member
27 fourth pressure sensor

The invention claimed is:

1. A method for the hydroerosive processing of components, in which a liquid comprising grinding particles flows over surfaces of the component, in a device having a channel through which the liquid comprising grinding particles flows under pressure and in which the component to be processed is received, and in which a valve, with which the flow of the liquid can be adjusted, is positioned in front of the component in the flow direction, comprising the following steps:

(a) closing the valve in front of the component and generating a predetermined pressure in the liquid comprising the grinding particles;

(b) opening the valve in front of the component and setting up a first volumetric flow of the liquid comprising the grinding particles, which is from 5 to 80% less than a product of a minimum setpoint cross-sectional area flowed through and a maximum permissible speed at this position, without the predetermined pressure generated in step (a) being changed;

(c) measuring a pressure difference which is set up between a position in front of the component to be processed and a position behind the component to be processed in the liquid comprising the grinding particles;

(d) increasing the volumetric flow of the liquid comprising the grinding particles until the volumetric flow corresponds to the product of the minimum setpoint cross-sectional area flowed through and the maximum permissible speed at this position, as soon as the pressure difference measured in step (c) has decreased by from 5 to 80%;

(e) closing the valve in front of the component and terminating the flow, as soon as the volumetric flow in step (d) corresponds to the product of the minimum setpoint cross-sectional area flowed through and the maximum permissible speed at this position.

2. The method according to claim 1, wherein the volumetric flow is increased continuously, constantly and monotonically increasingly in step (d).

3. The method according to claim 1, wherein the maximum permissible speed at the position of the minimum setpoint cross-sectional area flowed through lies in the range of from 1 m/s to 99% of the speed of sound.

4. The method according to claim 1, wherein the maximum permissible speed is determined by a simulation calculation.

5. The method according to claim 1, wherein a shape of the component is modeled in a simulation calculation before the grinding process.

6. The method according to claim 1, wherein, in the case of outer surfaces to be processed, the component is positioned inside the channel so that the liquid comprising grinding particles can flow over the outer surfaces.

7. The method according to claim 1, wherein, in the case of inner surfaces to be processed, the component is fitted into the channel in such a way that all of the liquid comprising grinding particles flows through the interior of the component to be processed.

8. The method according to claim 1, wherein, in order to detect cavitation, a sound sensor is positioned in the channel behind the component or at the component, and if cavitation occurs the volumetric flow is reduced until cavitation is no longer detected.

9. The method according to claim 1, wherein the liquid comprising grinding particles is provided in a storage container and flows back into the storage container after flowing over the surfaces to be processed of the component.

10. The method according to claim 9, wherein the liquid comprising grinding particles is relaxed before flowing into the storage container.

11. The method according to claim 1, wherein a second valve is positioned behind the component, and the volumetric flow and the pressure in the liquid comprising the grinding particles are adjusted by means of the first valve and the second valve.

12. The method according to claim 11, wherein, before closing the valve in front of the component in step (e), the second valve behind the component is closed as soon as the volumetric flow corresponds to the product of the minimum setpoint cross-sectional area flowed through and the maximum permissible speed at this position in step (d).

13. The method according to claim 1, wherein the pressure of the liquid comprising grinding particles is measured in step (a) with a first pressure sensor, which is positioned between the valve in front of the component and a pump, with which the pressure and the flow of the liquid comprising grinding particles are generated.

14. The method according to claim 1, wherein, in order to determine the pressure difference, the pressure is measured with a second pressure sensor, which is positioned between the valve in front of the component and the component, and a third pressure sensor, which is positioned behind the component.

* * * * *